US006217327B1

(12) United States Patent
Bedi

(10) Patent No.: US 6,217,327 B1
(45) Date of Patent: Apr. 17, 2001

(54) SOFT SCRUB AND SPRAY METHOD

(76) Inventor: Satnam S. Bedi, 6505 Sugar Tree Dr., Spring Hill, FL (US) 34607

( * ) Notice: Subject to any disclaimer, the term of this patent is extended or adjusted under 35 U.S.C. 154(b) by 0 days.

(21) Appl. No.: 09/498,899

(22) Filed: Feb. 4, 2000

(51) Int. Cl.[7] ..... A61G 17/02
(52) U.S. Cl. ..... 433/80
(58) Field of Search ..... 433/80, 82, 88, 433/89; 601/162, 163, 164, 165

(56) References Cited

U.S. PATENT DOCUMENTS

| | | | | |
|---|---|---|---|---|
| 4,078,558 | * | 3/1978 | Woog et al. | 601/162 |
| 4,903,688 | * | 2/1990 | Bibby et al. | 433/80 |
| 5,055,043 | * | 10/1991 | Weiss et al. | 433/80 |
| 5,503,553 | * | 4/1996 | Hines | 433/80 |
| 5,573,398 | * | 11/1996 | Towle et al. | 433/80 |

FOREIGN PATENT DOCUMENTS

| | | | | |
|---|---|---|---|---|
| 3325691 | * | 1/1985 | (DE) | 433/80 |

* cited by examiner

*Primary Examiner*—Todd E. Manahan

(74) *Attorney, Agent, or Firm*—Ronald E. Smith; Smith & Hopen, P.A.

(57) ABSTRACT

Warm water, (preferably 110° F.) in a reservoir is delivered under pressure to teeth and gums in a spray or mist that is emitted from the bristle-carrying base of a toothbrush. The spray loosens food particles and plaque deposits from tooth surfaces and facilitates their removal by the physical action of the bristles. An inlet conduit has a free end positioned within the reservoir, above the water level, and an outlet conduit has a free end immersed within the water contained in the reservoir. A pump in fluid communication with the inlet conduit pumps air into the container and the pressure in the container drives the water into the outlet conduit and to the toothbrush. A closure member in the container is apertured to accommodate the inlet and outlet conduits. A bypass conduit bypasses the reservoir and interconnects the inlet and outlet conduits, and ambient air enters a suction end of the pump and flows into the container and through the bypass conduit so that air bubbles enter into the water flowing from the reservoir to the toothbrush. In a second embodiment, a stannous fluoride tablet is dissolved in the water. In a third embodiment, gaseous fluid under pressure is introduced into the inlet conduit and in a fourth embodiment, a medication such as an antibiotic is introduced into the outlet conduit to enhance the therapeutic effects of the system.

19 Claims, 2 Drawing Sheets

SOFT SCRUB AND SPRAY METHOD

BACKGROUND OF THE INVENTION

1. Field of the Invention

This invention relates, generally, to the art of dental hygiene. More particularly, it relates to an apparatus and method for tooth brushing that provides a soft scrubbing action to loosen food particles and plaque and which applies a mist or spray to wash away the food particles at the same time. It also relates to a method for delivering stannous fluoride to tooth surfaces to protect them from acid attack which causes caries.

2. Description of the Prior Art

It is well known that the mechanical action of toothbrush bristles can loosen food particles and plaque buildup from tooth surfaces and a water spray can wash away the loosened particles. However, it is not easy to scrub all tooth surfaces and apply a water spray at the same time. It would be very useful where braces are worn to have a mechanical scrubbing action and a water spray at the same time.

Moreover, it is well-known that fluoride has a beneficial effect on teeth. It reduces the solubility of enamel by protecting the enamel from attack by acids of the type produced by bacteria. Moreover, studies have shown that stannous fluoride has much more efficacy in this regard than sodium fluoride. More particularly, it is about four times as effective as sodium fluoride.

Both calcium and phosphate are found in enamel. Stannous fluoride forms links with both of them to prevent their extraction from the tooth by the acid that begins forming about twenty four hours after plaque has begun to form on the surface of a tooth.

Although most clinical trials have tested stannous fluoride in ten per cent (10%) concentrations, studies have shown that the decrease in effectiveness is very small even with concentrations as low as 0.4%. 0.2%, and 0.1%.

One widely used technique for delivering fluoride to teeth is to add it to local drinking water supplies. Another method is to add it to toothpaste.

Neither of these methods is completely satisfactory, because many people live in cities that do not fluoridate their drinking water system, and stannous fluoride is not found in commercially-available toothpaste.

Moreover, studies have shown that a topically-applied, water-free 0.4% solution of stannous fluoride is more effective than a toothpaste originally prepared to contain 0.4% stannous fluoride. Studies have also demonstrated that a freshly prepared 0.2% stannous fluoride solution is significantly more effective in protecting a tooth surface than a 50:50 slurry of water and 0.4% stannous fluoride gel, or a slurry of water and a leading brand of toothpaste.

Although a dentist can topically apply stannous fluoride to the teeth of patients during an office visit, it is obviously impractical for everyone to visit a dentist twice a day, or even once a day.

Thus, there is a need for a consumer-operated device capable of loosening food particles and plaque deposits from all tooth surfaces so that the mechanical action of toothbrush bristles, coupled with a water spray, may remove such deposits before acid formation may begin. There is also a need for a means for topically applying stannous fluoride to tooth surfaces in effective concentrations in the convenience of one's home. The needed device should not require the user to prepare a gel or a slurry. Instead, the device should be easy to use and compact in size so that it could be stored on a sink or countertop. Its method of use should be self-evident, and it should be constructed of low cost materials so that it is affordable by the average consumer. It should also be useable by people with sensitive teeth and by people with braces. For example, the needed device should be capable of delivering water temperatures of about 110° F. because warm water is not only comfortable for people with sensitive teeth, but it also serves to promote the dissolution of plaque deposits.

It is also well-known that many people leave the water running during tooth brushing, thereby wasting large quantities of water. Thus, there is also a need for a tooth-care system that would conserve water.

Accordingly, if an apparatus and method could be found that could deliver a mist or spray to tooth surfaces to loosen food particles at the same time mechanical brushing is taking place, that could deliver stannous fluoride in an effective form to protect the teeth from acid attack, that would also conserve water, and that would be useable by people with sensitive teeth, braces, or both, then the art of dental care would be advanced in a substantial way.

However, it was not obvious to those of ordinary skill in this art how such an apparatus and method could be provided, in view of the art considered as a whole at the time the present invention was made.

SUMMARY OF THE INVENTION

The long-standing but heretofore unfulfilled need for an innovation that overcomes the limitations of the prior art is now met by a new, useful, and nonobvious invention including a reservoir means for containing a predetermined volume of a liquid fluid such as water. The novel apparatus includes a toothbrush having bristles and a base to which the bristles are mounted. A plurality of apertures is formed in the base and an outlet conduit means provides fluid communication between the reservoir means and the apertures. An air pump is in fluid communication with an inlet conduit that has a free end positioned within the reservoir means at a preselected location above a liquid level in the reservoir means. It pumps the liquid fluid from the reservoir means to the apertures through the outlet conduit.

A bypass conduit provides fluid communication between the inlet conduit and the outlet conduit, bypassing the reservoir. The pump includes a suction inlet that takes in ambient air and a compression outlet in fluid communication with the inlet conduit. Some of the air flows through the bypass conduit and enters into the water flowing through the outlet conduit at a point upstream of the toothbrush so that bubbles are formed in that water. This produces a spray or mist where the water flows out of the toothbrush base through the bristles.

A valve is preferably provided in the bypass conduit to regulate the flow of air therethrough.

In a second embodiment, stannous fluoride is added to the water in the reservoir.

In a third embodiment, a first introducing means introduces a preselected gaseous fluid into the liquid fluid at a preselected location in the inlet conduit. The introducing means includes a remote source of a preselected gaseous fluid under pressure. The remote source is in valved fluid communication with the inlet conduit.

In a fourth embodiment, a second introducing means introduces a therapeutic substance such as an antibiotic or the like into the outlet conduit.

It is a primary object of this invention to provide a low cost, easy-to-use apparatus for use by individuals in their homes that delivers a spray or mist of water to all tooth surfaces to loosen food particles.

Another object is to provide such an apparatus that delivers warm water (approximately 110° F.) to all tooth surfaces.

Another major object is to provide an apparatus that allows a soft scrubbing action to remove the loosened food particles from all tooth surfaces at the same time that the water spray is provided.

Still another important object is to provide an apparatus and method for delivering stannous fluoride to tooth surfaces in a highly effective form.

Another object is to provide an apparatus that delivers stannous fluoride to tooth surfaces in an effervescent liquid medium to enhance the protective effect of the fluoride.

Another object is to provide an apparatus that delivers therapeutic substances to the teeth and gums.

Still another object is to provide an oral hygiene system that is suitable for use by people with braces or sensitive teeth or both.

Yet another object is to provide an apparatus that has beneficial side effects such as the reduction of bad breath, tongue-cleaning, and water conservation.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawing, in which.

DETAILED DESCRIPTION OF THE PREFERRED EMBODIMENT

Figure 1:
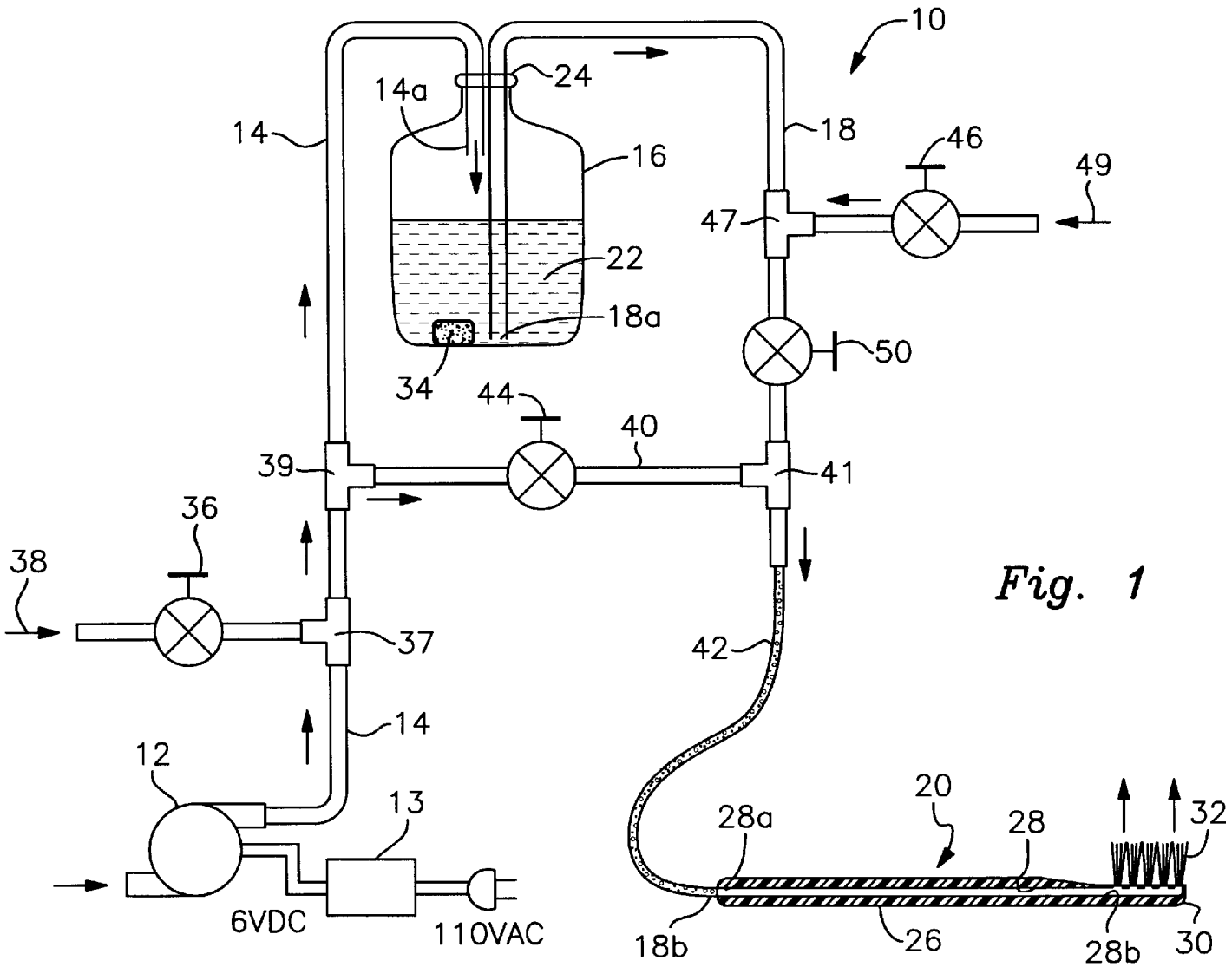
FIG. 1 is a schematic diagram of the novel apparatus.

Referring now to the FIG. 1, it will there be seen that an exemplary embodiment of the invention is denoted as a whole by the reference numeral 10.

In its simplest form, tooth-cleaning system 10 includes a pump 12 in fluid communication with inlet conduit 14, a container 16, an outlet conduit 18 and a toothbrush 20. In this configuration, container 16 is a reservoir for a liquid fluid, preferably warm (110° F.) water 22. Inlet conduit 14 has a free end 14*a* positioned above the level of said liquid 22, i.e., in non-immersed relation thereto, and outlet conduit 18 has a free end 18*a* immersed within said liquid 22, as depicted. In this way, ambient air is pumped through inlet conduit 14 by pump 12 into container 16.

A suitable closure means, such as a cork or other air-tight sealing means 24 closes open-mouthed container 16 and has suitable apertures formed therein to receive inlet conduit 14 and outlet conduit 18. Accordingly, when pump 12 is activated, air pressure within container 16 drives liquid 22 into outlet conduit 18. The flow rate of liquid 22 is constant and uninterrupted during the tooth cleaning process.

Container 16 preferably holds approximately two cups (16 ounces) of solution. It has been found that a good job of teeth-cleaning can be accomplished with about 10–12 fluid ounces of water. The novel apparatus dispenses that amount of water in about two minutes, which allows plenty of time for thorough tooth brushing.

Toothbrush 20 has a hollow handle 26 with inner passageway 28 formed therein. The proximal end 28*a* of inner passageway 28 is in fluid communication with distal end 18*b* of outlet conduit 18 by means of any suitable connector means. The distal end 28*b* of inner passageway 28 is in fluid communication with bristle base 30 which is suitably apertured to allow liquid 22 to flow between bristles 32 substantially as depicted. In an unillustrated alternative form of the novel apparatus, outlet conduit 18 bypasses handle 26 and is connected directly to bristle base 30.

Pump 12 is preferably a six volt pump and may be battery operated by four AA batteries 13. Alternatively, it may be powered by conventional household current that is rectified and stepped down to six volts. It produces a constant volumetric flow of about one liter per minute so that the liquid flow from reservoir 16 is steady.

For users with sensitive teeth, liquid 22 is preferably warm tap water (110° F.). Bristles 32 must contact the tooth surfaces to physically remove the loosened food particles, but the brushing action can be quite soft.

Significantly, the first embodiment includes bypass conduit 40 that interconnects inlet conduit 14 and outlet conduit 18 at a preselected location. The opposite ends of bypass conduit 40 are positioned in fluid communication with inlet and outlet conduits 14 and 18, respectively, by "T"-shaped fittings 39, 41. Bypass conduit 40 provides fluid communication between inlet conduit 14 and outlet conduit 18 so that air or other gaseous fluid may bypass reservoir 16 and become entrained in the liquid flowing toward toothbrush 20 through outlet conduit 18 as indicated by bubbles 42. This effervescence is beneficial because it produces a gas/liquid discharge at bristles 32, enhancing the cleaning action of the fluoridated water. The effervescence also slows down the rate of water flowing out of container 16 so that it is not emptied too quickly.

Control valve 44 may be positioned in bypass conduit 40 to control the flow rate of gaseous fluid therethrough. If control valve 44 is closed, no bubbles will appear in outlet conduit 18 and the solution in reservoir 16 will be emptied quite quickly, i.e., in less than a minute when said reservoir 16 is holding about 10–12 ounces of solution. This may not allow the user sufficient time to thoroughly apply the solution to all tooth surfaces. If control valve 44 is opened all the way, the gas pressure may be too high and the amount of effervescence may be so high as to slow down the emptying of reservoir 16 too much. It has been found that the amount of effervescence is about right when control valve 44 is about half open. This allows the user about two minutes to perform the tooth brushing procedure.

In a second embodiment, a tablet 34 of stannous fluoride or equivalent is dissolved in liquid 22 prior to use of novel apparatus 10. Accordingly, the structure just described delivers dissolved stannous fluoride to the teeth of a user. Significantly, the dissolved stannous fluoride is in a highly effective form and is capable of protecting the teeth against acid attack. Accordingly, if the novel apparatus is used after every meal, the bristles will loosen the food particles and plaque deposits, the water will wash away the loosened food particles and plaque deposits, and the stannous fluoride will protect the enamel. Twice daily use, about every twelve hours, will also be highly effective in cleaning the teeth and in reducing enamel solubility.

In a third embodiment of the invention, a gaseous fluid such as carbon dioxide, oxygen, nitrogen, or mixtures thereof, for example, is entrained into inlet conduit 14 to enhance the operation of the apparatus. For example, oxygen delivery may be beneficial for a patient who has undergone a tooth extraction or other surgical procedure. A first introducing means includes flow control valve 36, positioned in a conduit confluent with the base of a "T"-connector 37, and provides adjustable fluid communication between a source 38 of gaseous fluid under pressure and inlet conduit 14. The preferred flow rate is about one liter per minute.

In a fourth embodiment, a second introducing means includes another control valve 46, positioned in a conduit confluent with the base of "T" connector 47, controls the flow rate of a preselected medication into outlet conduit 18. Specifically, connector 47 provides fluid communication between a source 49 of medication under pressure and outlet conduit 18. The medication may be an antibiotic or other therapeutic agent having utility in the care of the teeth and gums.

Control valve 50 in outlet conduit 18 provides additional control.

Figure 2:
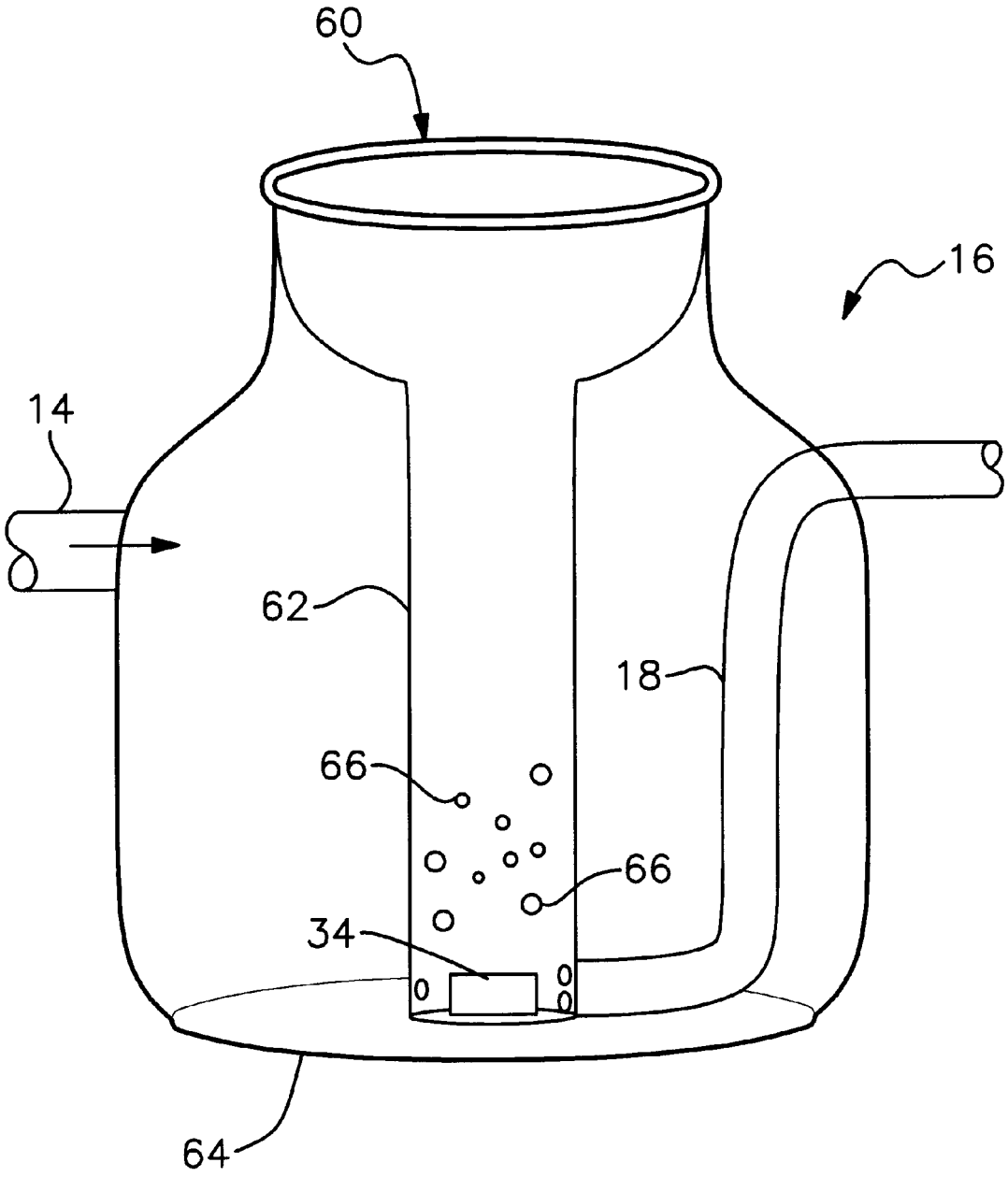
FIG. 2 is an elevational view of a second embodiment of the reservoir that holds water and a stannous fluoride tablet.

FIG. 2 depicts an alternative structure for reservoir 16. A funnel 60 having a downspout 62 is disposed within said reservoir in upstanding relation to bottom wall 64 of reservoir 16. Stannous fluoride tablet 34 is positioned within downspout 62. Perforations 66 are formed in downspout 62. Outlet conduit 18 is in fluid communication with the lowermost end of downspout 62. In this way, tablet 34 is dissolved uniformly and the dissolved medication is promptly carried away by outlet conduit 18. Tablet 34 may have multiple layers. For example, it could have an outer layer of baking soda and its interior could include stannous fluoride. An innermost layer could include a breath freshener so that the user feels refreshed when the cleaning has been completed.

The novel apparatus has numerous advantages. The warm spray of water loosens food particles and helps to dissolve plaque and eases their subsequent removal by brushing. The stannous fluoride dissolved therein reduces the enamel solubility of the cleaned teeth in a highly efficient manner. The apparatus and method effectively clean teeth fitted with braces and provides a comfortable cleaning for those having sensitive teeth. The tongue can also be cleaned, reducing halitosis. Moreover, the novel apparatus requires less water than conventional tooth brushing.

The novel apparatus delivers free stannous fluoride ions to the teeth and gums. These ions are easy to absorb and are not found in conventional toothpastes. Free stannous fluoride ions are also available to fight infection.

This invention represents a major breakthrough in the art of dental care. Being drawn to a pioneering invention, the claims that follow are entitled, as a matter of law, to broad interpretation to protect the heart or essence of the invention from piracy.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An apparatus for loosening and removing food particles and plaque deposits from tooth surfaces, comprising:

a reservoir means for containing a predetermined volume of a liquid fluid;

a toothbrush having bristles and a base to which said bristles are mounted;

a plurality of apertures formed in said base;

an outlet conduit providing fluid communication between said reservoir means and said apertures;

an inlet conduit having a first end in fluid communication with ambient air and a second end positioned within said reservoir means at a preselected location above a liquid level in said reservoir means;

a bypass conduit providing fluid communication between said inlet conduit and said outlet conduit, said bypass conduit bypassing said reservoir means;

a pump means having a suction inlet for intake of ambient air and a compression outlet in fluid communication with said inlet conduit;

said pump means being positioned upstream of said bypass conduit so that said pump means simultaneously pumps said liquid fluid from said reservoir means and pumps air through said bypass conduit so that air pumped to said base contains air bubbles;

whereby said liquid fluid is applied to tooth surfaces in a spray or mist that is effective to loosen food particles and plaque deposits from tooth surfaces so that said food particles are removed from said tooth surfaces by said bristles during tooth brushing; and whereby the spray or mist is applied at the same time that the brushing takes place.

2. The apparatus of claim 1, further comprising a control valve disposed in said bypass conduit for controlling the amount of air bubbles introduced into said outlet conduit and thereby controlling the flow rate of liquid fluid from said reservoir.

3. The apparatus of claim 1, further comprising a first introducing means for introducing a preselected gaseous fluid into said inlet conduit.

4. The apparatus of claim 3, wherein said first introducing means is positioned in fluid communication with said inlet conduit at a preselected location between said pump means and said reservoir means, said first introducing means including a pressurized source of a preselected gas under pressure, said pressurized source being in valved communication with said inlet conduit.

5. The apparatus of claim 3, further comprising a second introducing means for introducing a therapeutic substance into said outlet conduit.

6. The apparatus of claim 5, wherein said second introducing means includes a remote source of a therapeutic substance under pressure, said remote source being in valved communication with said outlet conduit.

7. The apparatus of claim 1, wherein said liquid fluid in said reservoir means includes a solution of stannous fluoride of predetermined strength dissolved therein.

8. An apparatus for delivering a therapeutic substance to teeth and gums, comprising:

a reservoir means for containing a predetermined volume of a liquid fluid;

said liquid fluid having said therapeutic substance dissolved therein;

a toothbrush having bristles and a base to which said bristles are mounted;

a plurality of apertures formed in said base;

an inlet conduit having a free end positioned within said reservoir means at a preselected location above a liquid level in said reservoir means;

an outlet conduit providing fluid communication between said reservoir means and said apertures;

a bypass conduit providing fluid communication between said inlet conduit and said outlet conduit said by pass conduit bypassing said reservoir means;

pump means for pumping said liquid fluid from said reservoir means to said apertures through said outlet conduit at a constant flow rate so that the flow is not interrupted during teeth cleaning; and said pump means being in fluid communication with said inlet conduit;

whereby said therapeutic substance is delivered to teeth and gums of a user.

9. The apparatus of claim 8, wherein said liquid fluid is water.

10. The apparatus of claim 8, wherein said therapeutic substance is fluoride.

11. The apparatus of claim 8, wherein said therapeutic substance includes free fluoride ions.

12. The apparatus of claim 8, wherein said therapeutic substance is stannous fluoride.

13. The apparatus of claim 8, further comprising:

a funnel disposed in said reservoir;

said funnel having a downspout disposed in upstanding relation to a bottom wall of said reservoir;

a dissolvable, dentally therapeutic tablet positioned within said downspout in overlying relation to said bottom wall;

a plurality of perforations formed in said downspout near a lower end thereof so that a dentally therapeutic substance is released into said reservoir through said perforations as said tablet dissolves; and said outlet conduit having a first end disposed in closely spaced relation to said lower end of said downspout so that said dentally therapeutic substance is transported by said outlet conduit to said apertures formed in said base of said toothbrush.

14. The apparatus of claim 8, wherein said pump means is an air pump.

15. The apparatus of claim 14, wherein said air pump is battery operated.

16. The apparatus of claim 14, wherein said air pump is operated on household alternating current that is stepped down in voltage.

17. The apparatus of claim 8, further comprising a first introducing means for introducing a gaseous fluid into said liquid fluid at a preselected location in said inlet conduit, said first introducing means including a remote source of a preselected gaseous liquid under pressure, said remote source being in valved fluid communication with said inlet conduit.

18. The apparatus of claim 17, further comprising a second introducing means for introducing a therapeutic substance into said outlet conduit, said second introducing means including a remote source of a therapeutic substance under pressure, said remote source being in valved communication with said outlet conduit.

19. The apparatus of claim 8, further comprising a control valve disposed in said bypass conduit for controlling the amount of effervescence introduced into said outlet conduit.

* * * * *